US006991065B2

(12) United States Patent
Leslie et al.

(10) Patent No.: US 6,991,065 B2
(45) Date of Patent: Jan. 31, 2006

(54) MAIN LINE WAYSIDE RAIL LUBRICATING SYSTEM WITH FEEDBACK

(76) Inventors: Carlton L. Leslie, 10 S. 170 Alma La., Naperville, IL (US) 60564; Kevin Kostelny-Vogts, 40 N. Commonwealth Ave., Elgin, IL (US) 60123

( * ) Notice: Subject to any disclaimer, the term of this patent is extended or adjusted under 35 U.S.C. 154(b) by 137 days.

(21) Appl. No.: 10/223,520

(22) Filed: Aug. 19, 2002

(65) Prior Publication Data

US 2004/0031647 A1 Feb. 19, 2004

(51) Int. Cl.
*F16N 1/00* (2006.01)

(52) U.S. Cl. ..... 184/2; 291/1; 291/3; 104/242; 74/467; 74/587; 74/605; 508/110; 73/280

(58) Field of Classification Search ..... 184/2, 184/3.1; 291/1, 3; 104/242
See application file for complete search history.

(56) References Cited

U.S. PATENT DOCUMENTS

| | | | | | |
|---|---|---|---|---|---|
| 1,386,426 | A | | 8/1921 | Riddle | |
| 1,709,095 | A | | 4/1929 | Protzeller | |
| 2,285,082 | A | | 6/1942 | Bolt | |
| 2,718,280 | A | | 9/1955 | Hurrell | |
| 2,814,422 | A | | 11/1957 | Mercier | |
| 3,051,262 | A | | 8/1962 | Bettison | |
| 3,059,724 | A | | 10/1962 | Soule | |
| 4,198,164 | A | * | 4/1980 | Cantor | 356/623 |
| 4,214,647 | A | | 7/1980 | Lutts | |
| 4,230,045 | A | * | 10/1980 | Fearon | 104/279 |
| 4,245,719 | A | | 1/1981 | Frank | |
| 4,334,596 | A | | 6/1982 | Lounsberry | |
| 4,346,785 | A | | 8/1982 | Frank | |
| 4,393,957 | A | * | 7/1983 | Hawthorne | 184/3.1 |
| 4,520,901 | A | | 6/1985 | Borup | |
| 4,711,320 | A | | 12/1987 | Dombroski et al. | |
| 4,726,448 | A | | 2/1988 | Schroeder et al. | |
| 4,856,617 | A | * | 8/1989 | Lounsberry, III et al. | 184/3.1 |
| 4,930,600 | A | | 6/1990 | Kumar et al. | |
| 5,080,195 | A | * | 1/1992 | Mizumoto et al. | 184/6.4 |
| 5,129,606 | A | | 7/1992 | Rodems et al. | |
| 5,186,280 | A | | 2/1993 | Mattcheck | |
| 5,477,941 | A | | 12/1995 | Kumar et al. | |
| 5,492,642 | A | | 2/1996 | Mulvihill | |
| 5,687,814 | A | * | 11/1997 | Craig et al. | 184/3.2 |
| 5,842,543 | A | | 12/1998 | Naito et al. | |
| 5,896,947 | A | | 4/1999 | Kumar | |
| 6,076,637 | A | | 6/2000 | Kumar | |
| 6,170,594 | B1 | * | 1/2001 | Gilbert | 180/282 |
| 6,170,610 | B1 | | 1/2001 | Kumar | |
| 6,199,661 | B1 | | 3/2001 | Kumar | |
| 6,446,754 | B1 | * | 9/2002 | Kostelny-Vogts et al. | 184/3.1 |
| 6,578,669 | B2 | * | 6/2003 | Kast et al. | 184/3.2 |
| 6,585,085 | B1 | * | 7/2003 | Kumar | 184/3.2 |

FOREIGN PATENT DOCUMENTS

| | | | |
|---|---|---|---|
| DE | 4141049 A1 | * | 7/1992 |
| JP | 05004583 A | * | 1/1993 |

* cited by examiner

*Primary Examiner*—David A. Bucci
*Assistant Examiner*—Patrick J. Tangney
(74) *Attorney, Agent, or Firm*—C. John Brannon; Bingham McHale, LLP

(57) ABSTRACT

To lubricate a length of track, a plurality of lubricating nozzles are provided. Each nozzle is fed by the output of a single positive displacement pump, and all the pumps are controlled by a computer. Vibration sensors, sound sensors, or L/V ratio sensors detect physical qualities which occur as a train passes a given point, and another detector measures the time between successive wheels on the truck of a car as it passes a given point to measure train speed. The computer compares the output readings measured by the detector to a table of outputs in its memory that are indicative of a lubricated track to determine if lubrication is needed.

16 Claims, 2 Drawing Sheets

MAIN LINE WAYSIDE RAIL LUBRICATING SYSTEM WITH FEEDBACK

The present application relates to the lubricating of railway tracks and, in particular, to lubrication of the main line tracks with a feedback system to regulate the application of lubricant.

BACKGROUND OF THE INVENTION

It is well known that the lubrication of railway tracks extends the useful life of the railway track and the life of the wheels of railroad cars. Lubricants have also been applied railroad tracks to reduce the amount of noise which is emitted by the interaction of the wheels and the tracks.

Existing lubricating systems, however, apply lubricants to the track on a continuous basis which results in the uneven application of lubricant and the over lubrication of portions of the tracks near the dispensing nozzles. Over lubrication causes excess lubricant to accumulate on the ground and become an environmental hazard as well as being a waste of lubricant. Where the lubricant is intended to be applied to the gauge face of a track, over lubrication results in the transfer of the lubricant to the top of the rail and causes adhesion problems for locomotives what subsequently pass over the tracks.

The need for lubrication is greatest at curves because lateral forces are applied to the gauge face of the track by the side of the wheels as the train turns through the curve. The application of the lateral forces increases friction and wear, and the track of a curve wears far more rapidly than does straightaway track. Not only do the tracks wear more rapidly at curves, the lateral forces applied thereto from the wheels of the turning train can cause the rail to become loosened from the ties. As the rails become loosened, the gauge, or spacing between the rails, may widen or a rail may roll over, resulting in the derailment of a train.

There is need, therefore, for an improved system which will monitor the application of lubricant to the rail of a mainline track so as to avoid over lubrication. There is also a need for monitoring portions of the track, especially at curves, for evidence of track failure in the form of a change in the gauge width or in the angle of the track.

SUMMARY OF THE INVENTION

Briefly, the present invention is an improved method of lubricating and monitoring main a length of line railway tracks, such as a curve. In accordance with the invention a plurality of lubricating nozzles are provided to apply lubricant to either the gauge face or the top of the track, depending on the type of lubricate to be applied. The same lubricating station may be used to apply lubricant to both the gauge face and the top of rail, although separate motors, pumps and nozzles as described below are needed for the two lubricating systems for the reasons set forth.

A reservoir is provided for each lubricant to be applied, the reservoirs or reservoirs being located in close proximity to a length of track where lubrication is desired. The nozzles are adapted to direct the lubricant to the surface to be lubricated by the associated system, the surfaces being either the gauge face or the top of the track. The nozzles are preferably arranged so as to apply a continues path of lubricant over a length of tracks equal or greater than the circumference of a typical wheel of a railroad car such that the movement of a wheel across the lubricated length of track will apply lubricant to the entire circumference of the wheel. The subsequent movement of the railroad car down the track will thereafter cause the wheel to apply lubricant to a succeeding length of track causing the lubricant to migrate down track as needed through the turn. The invention further includes a plurality of positive displacement pumps with the output of each pump directed to a different one of the nozzles. By providing positive displacement pumps, the volume of lubricant applied by each pump can be regulated by a computer and not be subject to variations caused by changes in the temperature of the viscosity of the lubricant as a result of weather or the like. In the event a port in a nozzle becomes clogged, the positive displacement pump with the output directed to a single nozzle is likely to result in the clearing of the nozzle. On the other hand, if a nozzle becomes so clogged that it cannot be cleared, the remaining nozzles will not be forced to receive excess lubricant. The variations in the application of lubricant caused by defective nozzles will thereby be reduced.

It has been found that a train moving across unlubricated tracks causes different physical reactions than a train moving along properly lubricated tracks. By measuring the physical reactions caused by the moving train and comparing them to reactions indicative of a train moving on an adequately lubricated track, taking into account the speed of the train, the adequacy of the lubrication can be determined.

In accordance with one embodiment of the invention, a vibration sensor to sense the vibrations caused as a result of a wheel of a railroad car moving across a length of rail. The vibration sensor may sense vibrations in the rail itself or detect the audible sound created by the vibrations as the wheel moves across the track. Poorly lubricated tracks have been found to produce an offensive high frequency noise. The invention further provides for a detector for detecting the passage of a wheel of a railroad car with respect to a certain point on the track. The trucks of a locomotive have six driving wheels each on three axles, whereas the trucks of a railroad car have four wheels on two axles. The axles on all trucks are spaced the same distance apart so that by measuring the shortest interval of time which elapses between successive axles and dividing the distance between the axles of a truck by the measured time, the speed of the train can be determined. Also, by detecting the number of axles on the trucks, a locomotive can be distinguished from the cars it is pulling or pushing. The presence of three axles on a truck can be detected by a computer program that will detect two successive short intervals of time between the passage of any three axles past the given point.

A computer is provided which is responsive to the wheel detector and to the vibration sensor and the output of the computer regulates the application of power to the positive displacement pumps which apply lubricant to the tracks.

In the preferred embodiment, the computer is programmed to detect the presence of the locomotive as it passes the wheel detector. The computer will allow the locomotive to pass a top of rail lubricating station before the application of lubricant commences, but will apply lubricant to the gauge face prior to the passage of the locomotive. As the locomotive and succeeding cars move down track and into the curve, the tracks vibrate and the frequency of the vibration, or of the sound caused by the vibration, is detected by detectors. The vibration detected from the vibration detectors is then compared with vibration rates in the computer's memory which are consistent with the speed of the train to determine whether the sound or vibration is consistent with a lubricated track or an unlubricated track. When the computer determines that the track is inadequately lubricated, the computer then sends a signal to the pumps to go on line and to apply lubricant to the surfaces of the track.

It should be appreciated that a train may be partially through a curve before the lubricating system commences the application of lubricant. To operate efficiently, lubricant is applied only while the train is passing the lubricating station and once the last car passes the lubricating station, the computer terminates the lubrication of the track.

When a second train approaches the length of track that has been lubricated by the system, the track may already be lubricated as a result of the preceding train. As the second train moves through the track, the wheel and vibration detectors again measure the speed of the train and compare the vibrations received from the track with vibration rates in the memory of the computer which correspond to vibrations from a train moving across lubricated tracks at its determined speed to again determine whether or not the track is adequately lubricated. As before, if the computer determines that the track is inadequately lubricated, power is again directed to the pumps to apply lubrication to the track. Once the computer determines that the vibration frequency has dropped to a rate which is consistent with the frequency generated by a train moving at its determined speed across a lubricated track, the pumps will be shut down.

In another aspect of the invention, the need for lubrication of the track can also be determined when an L/V sensor which detects the lateral/vertical forces being applied to the track, because it has been found that lubricated tracks have a lower L/V ratio than do unlubricated tracks. Of course, a fast train moving through a turn will also have a higher L/V ratio than a slow train moving through a curve. A computer can compare the detected L/V ratio against the acceptable L/V level stored in the computer memory for the speed of the train to determine whether or not the track is in need of lubrication.

As a further modification of the present invention, the track may be provided with a sensor to measure a change in the gauge width and with a roll over sensor to detect a change in the angle of the track. In the event the computer determines that the gauge width has changed beyond certain allowable maximums retained in the memory of the computer, or that the angle of the track has moved beyond certain predetermined maximums allowable as recorded in the computer memory, a warning signal can be generated. The warning signal may be transmitted by radio to a moving train approaching the monitored length of track or by wire to a central office. Alternately, the signal can be sent to a visual warning signal positioned along the track where it can be seen by the engineer of a train approaching the monitored length of track.

BRIEF DESCRIPTION OF THE DRAWINGS

A better understanding of the present invention will be had by a reading of the following detailed description taken in conjunction with the drawings wherein.

DETAILED DESCRIPTION OF THE PREFERRED EMBODIMENT

Figure 1:
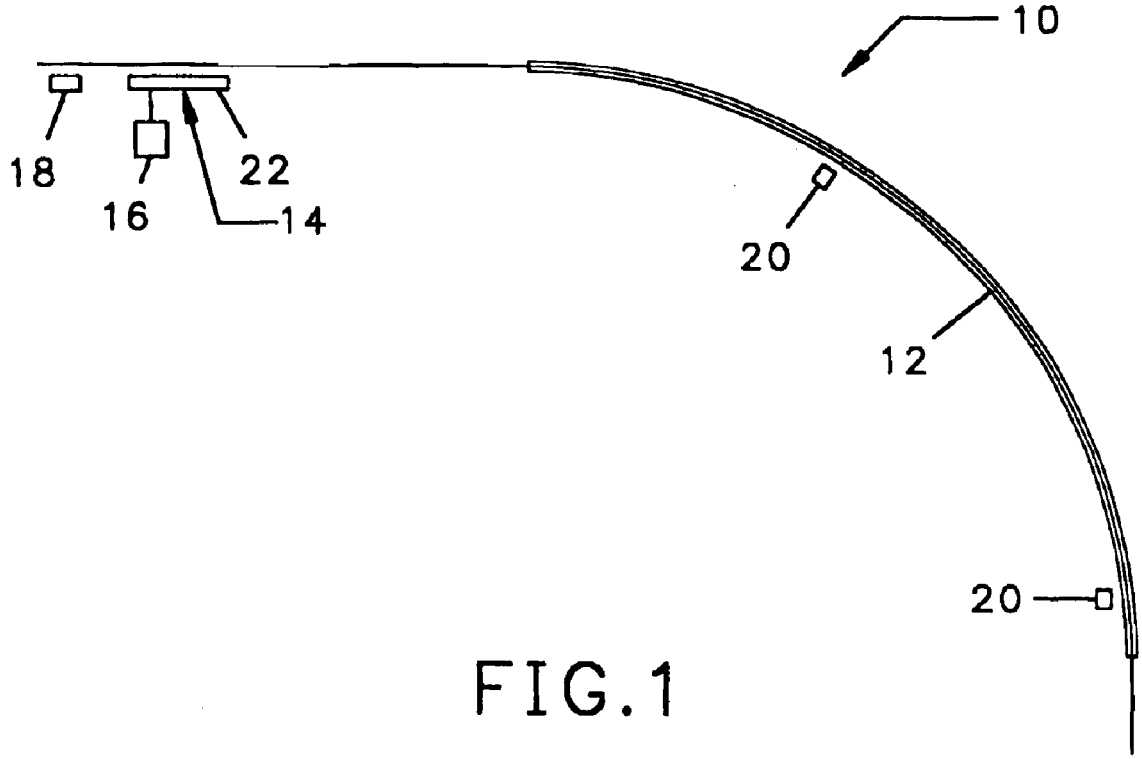
FIG. 1 is a schematic diagram of a length of main line track having a lubricating and feedback system in accordance with the present invention attached thereto.

Referring to FIG. 1, a length of railroad track 10 which extends through a curve 12 will undergo deterioration caused by the friction between the wheels of railroad cars and the track unless the track is adequately lubricated. To provide lubrication to the track 10 through the curve 12, a lubrication system 14 in accordance with the present invention is provided. The lubrication system 14 includes a reservoir 16 of lubricant, a first detector 18 for detecting the passage of a railroad wheel or axle with respect to a given point on the track 10, at least one down track vibration detector 20 (two of which are depicted), and a lubrication station 22, which includes a computer 23 (shown only in FIG. 4). The vibration detector 20 may detect either acoustical vibration or vibration within the track 10.

Figure 2:
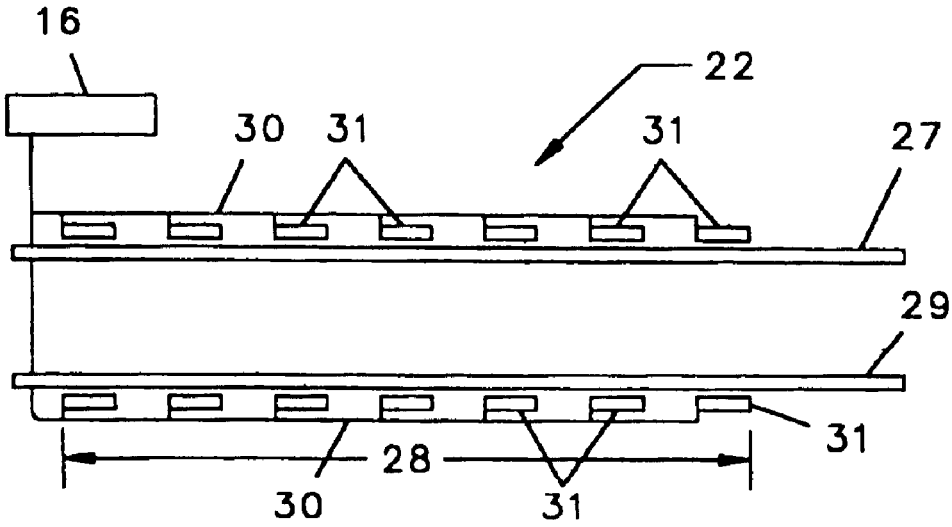
FIG. 2 is a schematic diagram of a lubrication station with a feedback system in accordance with the present invention.
Figure 3:
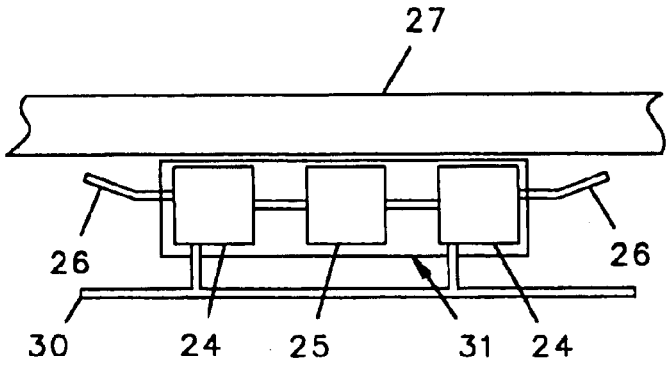
FIG. 3 is an enlarged schematic view of one of the motor, pump and nozzle modules which make up the lubrication station shown in FIG. 2.

Referring to FIGS. 2 and 3, in the preferred embodiment the lubrication station 22 consists of a plurality of positive displacement pumps 24—24 driven by motors 25—25, each pump 24—24 having an associated nozzle 26—26 positioned along a length 28 of the two rails 27, 29 of the track 10. Each of the pumps 24—24 is connected to the reservoir 16 by a feeder line 30 and the motors 25—25, the pumps 24—24 and nozzles 26—26 form modules 31—31. The modules 31—31 are spaced a short enough distance apart along the length 28 of the track such that the entire length 28 of the track will be lubricated without interruption on unlubricated portions when the motors 25—25 are simultaneously actuated by the computer 23. The length 28 of track 10 is at least equal to the circumference of a wheel of a typical railroad car such that the movement of a wheel along the length 28 of a track will cause the entire circumference of the wheel to contact the lubricated surface of the track and transfer lubricant to the wheel. The subsequent rotation of wheels as the train moves down track through the curve 12 will cause the lubricant to migrate down to the portion of the track which constitutes the curve 12.

In accordance with the present invention, each nozzle 26—26 has associated therewith its own positive displacement pump 24—24 such that the dispersement of lubricant through the nozzles 24—24 will be even throughout the length 28 of the track being lubricated. Furthermore, the use of positive displacement pumps enables the precise amount of lubricant to be applied regardless of changes in the viscosity or thickness of the lubricant as a result of temperature or of obstructions caused to individual nozzles 26—26. Where the nozzles 26—26 are tied together so as to receive lubricant from a single pump, as was the case with the prior art, lubricant may be distributed unevenly through the nozzles. The uneven distribution of lubricant will become accentuated if one or more of the nozzles becomes blocked. In the event of a blockage of one nozzle 26, in a system constructed in accordance with the present invention, the pressure generated by the associated pump 24 associated with the blocked nozzle should free the obstruction. In the event the obstruction continues, however, excess lubricant will not be not be directed to the remaining nozzles as was the case in the prior art.

Figure 4:
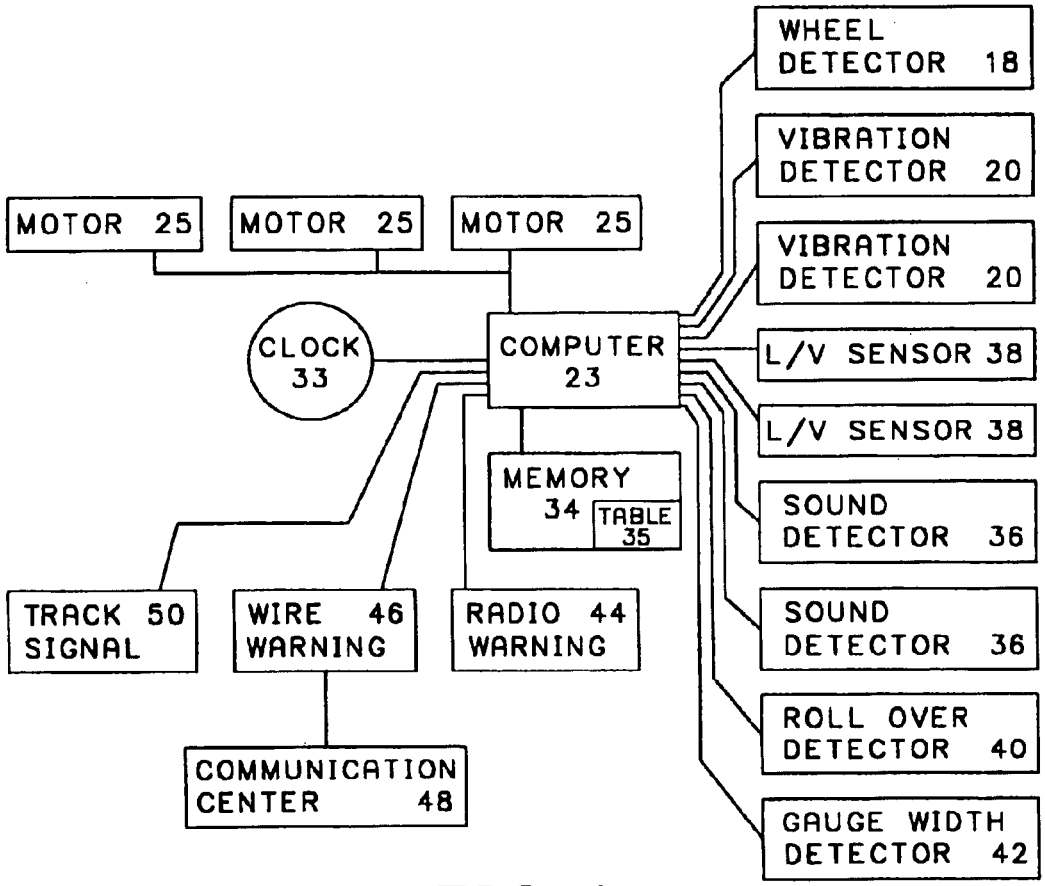
FIG. 4 is a block diagram of a control for the lubrication and feedback system shown in FIG. 2.

Referring to FIG. 4, the computer 23 is configured to receive input from the vibration detectors 20 down track from the lubrication station 22 and from the first detector 18. The computer 23 includes a clock 33 for measuring the time elapsing between successive wheels or axles on the trucks of the cars passing the detector 18 to determine the speed of the train. The determination of speed is reached by dividing the distance between the axles of the wheels on a truck of a railroad car and the time required for the successive axles of the truck to pass the first detector 18. A railroad car can be distinguished from the locomotive because the locomotive has three axles on each of its trucks whereas railroad cars have only two axles per truck.

The rolling of the wheels of a train across a track causes certain physical reactions which can be measured and vary principally as factors of train speed and track lubrication. Examples of such physical reactions which vary as factors of train speed and track lubrication are the maximum vibration frequency detectable within the track, the audio frequency (the screech or absence thereof) of sound generated by the wheels moving along the track, and the rate of lateral forces to the vertical forces (lateral/vertical) applied to the track, or the L/V ratio. These physical reactions can be measured and graphed for both lubricated tracks and unlubricated tracks as factors of train speed, and the results can be accumulated in a table 35 of maximum acceptable reaction readings. By measuring train speed and one of these variable reactions, the measured reaction for a moving train can be compared with the maximum acceptable measurement in the table 35. When the measured reaction exceeds the maximum measurement indicative of a lubricated track, the track is not adequately lubricated and more lubricant should be applied to the track. When the measured reaction falls within the maximum measurement indicative of a lubricated track, the track is presumed to be adequately lubricated, and no more lubricant is needed.

It has been found that when a track has been adequately lubricated, for any given speed of a train crossing the tracks, the track will vibrate below a given maximum threshold. At higher speeds the acceptable maximum thresholds of vibration are higher than at lower speeds and the maximum thresholds can be recorded in a table as factors of train speed. The invention, therefore, further includes a memory 34 in which is recorded a table 35 of the accepted maximum vibration rates for each given speed of a railroad train passing across the track.

The computer 23 receives signals from the first detector 18 and the vibration detectors 20 and uses the information plus that in the memory 34 to determine the speed of the train and therefore the maximum acceptable vibration rates. The detected vibration rates are subsequently compared to the maximum acceptable rates stored in the memory 34. In the event the vibrations from the detectors 20 exceed the maximum acceptable rate or rates, the computer 23 will direct the pumps 24—24 to begin applying lubricant to the tracks 10.

As previously stated the need for lubrication is different for a gauge face lubricant than for a top of track lubricant. A gauge face lubricant is intended to protect the rail from wear from the locomotive wheel flange and therefor it is desirable to apply a gauge face lubricant prior to the passage of every locomotive. On the other hand, a top of track lubricant protects the rail and rail car wheels from wear, but it inhibits the efficiency of the locomotive and should only be applied after the locomotive has passed.

When a long train is passing the curve 12, the lubricant applied to the tracks may be moved by the wheels across the entire curve 12. In that event, the vibration detectors 20 will detect a reduction in the vibration rate to below the maximum threshold and the computer 23 will terminate power to the motors 25—25, and therefore pumps 24—24 thereby terminating the application of lubricant. In the event the vibration detector 20 does not detect a reduction in the vibration rate, the computer 23 will continue to direct power to the pumps 24—24 until the computer 23 determines from input from the first detector 18 that the last car has passed. Power to the pumps 24—24 will then terminate.

When a subsequent train approaches the lubricating station 22 the computer 23 will recall that the track 10 is inadequately lubricated and will again direct power to the pumps to apply lubricant to the track 10. (As previously stated, for top of rail lubricants, the application of further lubrication will be delayed until the locomotive has passed the lubrication station.) The computer 23 will continue to direct power to the pumps 24—24 to cause further lubrication of the tracks 10 until the vibration rate of the tracks, as determined by the detectors 20, falls below the maximum acceptable rate for the speed of the train as recorded in the memory 34, after which power to the pumps 24—24 will be terminated.

As an alternative to the vibration detectors 20, audio sound detectors 36 may be used to detect the vibration rate generated by the contact of the wheels of the train to the track 10. A railroad car moving across an unlubricated curved track generates an unpleasantly sharp screech, which is not the case for a railroad car moving across lubricated curved track.

As an alternative to measuring the vibration in the track 10, a L/V sensor 38 which detects lateral/vertical force ratios may be used to monitor the need for lubricate on the curve 12 of the track 10. When a train moves through a curve lateral forces are applied to a track and a greater force is applied to the track when the train is moving at a high speed than at a lower speed. On the other hand, for a given speed of a train, a greater lateral force is applied to an unlubricated track than to a lubricated track. Accordingly, the memory 34 of the computer 23 has stored therein the maximum acceptable ratios of lateral forces to vertical forces for each speed of the train. The computer compares the L/V ratios from the down track sensors 38 with the acceptable maximum for a given speed as recorded in the memory 34 of the computer 23. In the event the maximum L/V ratio is exceeded, the computer 23 will direct power to the pumps 24—24 to apply lubricant to the track 10. The computer will continue to direct power to the pumps until the L/V ratio falls back to within acceptable parameters or until the cars of the train are no longer passing the lubricating station 22. The further application of lubricant to the track after the train has passed will cause excess lubricant to be deposited on the tracks.

Referring to FIGS. 2 and 3, in the preferred embodiment, each nozzle 26—26 and its associated pump 24—24 will comprise a single module 31 which is individually attachable to the length of track 10. Modular motorized pumps are presently available consisting of a pair of positive displacement pumps 24 driven by a single controllable motor 25, such as a stepper motor. By attaching one nozzle 26 to each of the pumps 24, one directed toward each end of a module 31, the number of modules needed to lubricate a length 28 of rail is equal to half the number of nozzles 26 needed to provide the desired lubrication.

The invention may further include a rollover detector 40 for detecting a change in the angle of the track and a gauge width detector 42 for detecting a change in the width of the gauge of the track for detecting potential track failure. A warning may be sent by radio 44 to an approaching train, or across a wire 46 to a communications center down track 48, or to a track signal system 50.

While the present invention has been described with respect to several embodiments, it will be appreciated that there are numerous other variations that fall within the scope of the present invention. It is therefore the intent of the following claims to cover all the variations and modifications which fall within the spirit and scope of the invention.

What is claimed:

1. A device for lubricating a length of railroad track comprising application means for applying a quantity of lubricant to a portion of track forward of said length of railroad track, means for detecting train speed of a train passing over said length of railroad track, lubrication detection means for measuring a physical reaction that varies as a factor of train speed and track lubrication, a table relating train speed and measurements of said physical reaction indicative of a lubricated track, wherein measurements of said physical reaction vary as a function of train speed, means for comparing said physical reaction measurement from said lubrication detection means with said measurements indicative of a lubricated track for a train moving at said train speed, and means for energizing said application means to apply a quantity of lubricant to said portion of said track where said means for comparing determines that said physical reaction measurement falls out side of said measurements indicative of a lubricated track.

2. The device of claim 1 wherein said physical reaction is a maximum vibration frequency detectable in said track and said lubrication detection means is a vibration detector.

3. The device of claim 1 wherein said physical reaction is an audio frequency emitted by wheels of said train as they move along said tracks and said lubrication detection means is an audio detector.

4. The device of claim 1 wherein said physical reaction is a ratio of lateral forces to vertical forces applied to said tracks and said lubrication detection means is a device for measuring the vertical and lateral forces applied to said track.

5. The device of claim 1 and further including a rollover detector for detecting a change in the angle of said track and a warning device responsive to said rollover detector.

6. The device of claim 1 and further comprising a gauge width detector for detecting a change in the width of the gauge of said railroad track and a warning device responsive to said gauge width detector.

7. The device of claim 1 wherein said means for detecting train speed measures the time elapsing between two successive wheels of a train rolling across a given point.

8. That the device of claim 1 wherein said application means includes a plurality of nozzles including a first nozzle and a last nozzle, where each of said plurality of nozzles is directed to a portion of said length of railroad track for dispensing lubricant to said portion between said first nozzle and said last nozzle, and a plurality of pumps equal in number to said plurality of nozzles with each one of said plurality of pumps pumping lubricant to only one of said nozzles wherein each one of said nozzles applies lubricant to said track independent of the operation of all others of said nozzles.

9. The device for lubricating a railroad track in accordance with claim 8 wherein said plurality of nozzles are spread a distance apart from one another to provide for the application of lubricant without interruption along said portion of said track.

10. The device for lubricating a railroad track in accordance with claim 8 wherein said portion of said track has a length at least equal to the circumference of a wheel of a railroad car.

11. The device of claim 1 wherein each of said plurality of pumps has a direct drive shaft extending from said pump to a motor.

12. The device of claim 11 and further comprising means for detecting the passage of an axle of a railroad car past a given point, means for distinguishing a truck of a railroad car from a truck of a locomotive by counting the number of axles on a truck where two axles on a truck is indicative of a railroad car and three axles on a truck is indicative of a locomotive, and means for energizing said pump for pumping lubricant after a truck of a locomotive of a train has passed said portion of said track wherein said track is lubricated after the passage of said locomotive.

13. The method of lubricating a length of railroad track comprising the steps of providing means for applying a quantity of lubricant to a portion of track in response to a dispensing signal, positioning said means for applying to dispense lubricant on said length of railroad track, providing means for measuring the speed of a train and generating a signal indicative of said speed, positioning said means for measuring for measuring the speed of a train crossing said length of railroad track, providing detection means for measuring a physical reaction that varies as a factor of train speed and track lubrication, positioning said detection means for detecting said physical reaction at a point on said length of railroad track, providing a table relating train speed to measurements of said physical reactions indicative of a lubricated track, wherein measurements of said physical reaction vary as a function of train speed, providing storage means for storing said table, storing said table in said storage means, providing determining means responsive to said signal indicative of said speed and employing said table to determine a range of measurements of said physical property indicative of a lubricated track, providing comparing means, comparing a measurement of said physical property from said detection means with said measurement indicative of a lubricated track, and generating a dispensing signal when said measurement of said physical property falls outside of said measurements indicative of a lubricated track.

14. The method of claim 13 wherein said means for applying a quantity of lubricant includes a plurality of nozzles including the first nozzle and a last nozzle for dispensing a lubricant, and said method comprises the further steps of positioning said nozzles along said length of railroad track, providing a plurality of pumps, connecting each of said pumps to supply lubricant to only one of said plurality of nozzles, providing a plurality of motors where in of said motors has a direct drive output, positioning said motors and said direct drives to direct drive to each one of said pumps wherein each one of said plurality of nozzles will operate independent of all others of said plurality of nozzles.

15. A device for lubricating a length of railroad track comprising means, responsive to a dispensing signal, for applying a quantity of lubricant to a portion of said track, means for measuring the speed of a train moving along said track and for generating a signal indicative of said speed, vibration detection means for detecting a maximum vibration frequency within said track, a lookup table relating train speed to the maximum acceptable vibration frequency within a track indicative of a lubricated track, wherein said maximum acceptable vibration frequency varies as a factor of train speed, means for storing said lookup table, means for determining a maximum acceptable vibration frequency in said track from said lookup table and said signal indicative of said speed, and comparing means for comparing said maximum acceptable vibration frequency to said maximum vibration frequency within said tracks and for generating a dispensing signal when said maximum vibration frequency within said tracks exceeds said maximum acceptable vibration frequency.

16. That the device of claim 15 wherein said means for applying a quantity of lubricant includes a plurality of nozzles including a first nozzle and a last nozzle where each of said plurality of nozzles directed to a portion of said length of railroad track for dispensing lubricant to said portion between said first nozzle and said last nozzle, and a plurality of pumps equal in number to said plurality of nozzles with each one of said plurality of pumps pumping lubricant to only one of said nozzles wherein each one of said nozzles applies lubricant to said track independent of the operation of all others of said plurality of nozzles.

* * * * *

UNITED STATES PATENT AND TRADEMARK OFFICE

CERTIFICATE OF CORRECTION

PATENT NO. : 6,991,065 B2
APPLICATION NO. : 10/233520
DATED : January 31, 2006
INVENTOR(S) : Carlton L. Leslie It is certified that error appears in the above-identified patent and that said Letters Patent is hereby corrected as shown below:

The inventorship on the Title page of the patent is incorrect. Carton L. Leslie is the sole inventor of the claimed invention.

Signed and Sealed this

Twenty-ninth Day of August, 2006

JON W. DUDAS
*Director of the United States Patent and Trademark Office*